US005173984A

United States Patent [19]

Kaye

[11] Patent Number: 5,173,984

[45] Date of Patent: Dec. 29, 1992

[54] SELF-DRYING POWERED DRAIN AUGER

[75] Inventor: Paul S. Kaye, Racine, Wis.

[73] Assignee: Lewisan Products, Inc., Racine, Wis.

[21] Appl. No.: 743,260

[22] Filed: Aug. 9, 1991

[51] Int. Cl.[5] ..... B08B 9/02

[52] U.S. Cl. ..... 15/104.33

[58] Field of Search ..... 15/104.33

[56] References Cited

U.S. PATENT DOCUMENTS

| | | | |
|---|---|---|---|
| 1,080,700 | 12/1913 | Kranebiel . | |
| 2,245,823 | 6/1941 | Rappaport | 15/104.33 |
| 2,284,939 | 6/1942 | Asnard | 15/104.33 |
| 2,661,489 | 12/1953 | Rudolph et al. | 15/104.33 |
| 2,828,133 | 3/1958 | Silverman | 279/83 |
| 3,609,788 | 10/1971 | Mier | 15/104.3 |
| 3,727,261 | 4/1973 | Levine | 15/104.33 |
| 4,290,162 | 8/1981 | Agostino | 15/104.33 |
| 4,317,247 | 3/1982 | Levine | 15/104.33 |
| 4,340,988 | 7/1982 | Shames et al. | 15/104.33 |
| 4,364,139 | 12/1982 | Babb et al. | 15/104.33 |
| 4,447,926 | 5/1984 | Rothenberger | 15/104.33 |
| 4,702,162 | 10/1987 | Sontheimer et al. | 99/495 |
| 4,706,321 | 11/1987 | Kaye | 15/104.33 |
| 4,763,374 | 8/1988 | Kaye | 15/104.33 |
| 4,793,017 | 12/1988 | Kaye | 15/104.33 |
| 4,944,465 | 7/1990 | Levine | 242/54 R |
| 4,956,889 | 9/1990 | Kirk | 15/104.33 |
| 5,018,234 | 5/1991 | Meyer et al. | 15/104.33 |

*Primary Examiner*—Edward L. Roberts

*Attorney, Agent, or Firm*—Jansson & Shupe, Ltd.

[57] ABSTRACT

The invention is an improvement in a drain-cleaning auger of the type having a round shell made from first and second subshells and a cavity within the shell for housing a drain-cleaning snake. In the improved auger, the first subshell has an outwardly-flared sidewall which increases in diameter and has its maximum diameter at the sidewall edge. The second subshell has an edge in close proximity to that of the first subshell. The subshell edges define a crack or slit-like opening between them for expulsion of water from the cavity by centrifugal force when the shell is power-rotated at high speed. The auger is thereby self-drying.

10 Claims, 7 Drawing Sheets

SELF-DRYING POWERED DRAIN AUGER

FIELD OF THE INVENTION

This invention is related generally to implements for cleaning drains and, more particularly, to such implements having auger-like rotatable snakes extendable for insertion into drains.

BACKGROUND OF THE INVENTION

One of the significant problems or complaints of homeowners and even plumbers about the process of unclogging drains is that drain snakes or the like, when they are withdrawn from drains, are debris-laden and wet. The problems of dirty drain-cleaning implements are well known and, for example, are mentioned in U.S. Pat. No. 4,914,776 (Kaye).

Left wet, the snake (and perhaps other metal parts) may be damaged by rust and/or corrosion. And the accumulation of wet, dirty debris within the snake-containing cavity can (and usually does) cause objectionable odors. Cleaning and drying of drain augers is a disagreeable task complicated by the fact that special steps, perhaps including auger disassembly, are typically required to remove the dirt and dry the snake. And the more difficult the task of dirt removal and drying, the less likely it is to be conscientiously performed each time a drain is cleaned.

Drain-cleaning augers, sometimes called plumber's tools, are shown and described in U.S. Pat. Nos. 2,828,133 (Silverman); 3,609,788 (Mier); 3,727,261 (Levine); 4,944,465 (Levine) and 4,956,889 (Kirk). Others are shown in U.S. Pat. Nos. 4,317,247 (Levine); 4,290,162 (Agostino); 3,897,602 (Waterburg); 4,218,802 (Babb et al.); 4,287,630 (Perez); 4,716,613 (Irwin) and 4,364,139 (Babb et al.). Types of centrifugal dryers are shown in U.S. Pat. Nos. 4,702,162 (Sontheimer et al.) and 1,080,700 (Kranebiel).

The prior patents noted above fail to recognize the problem of cleaning a wet, dirty drain auger and therefore, fail to suggest a solution. An improved powered drain auger which is easily cleaned and which has features to prevent entry of debris into the auger cavity would be an important advance in the art.

OBJECTS OF THE INVENTION

It is an object of the invention to overcome some of the problems and short-comings of the prior art.

Another object of the invention is to provide an improved drain auger which may be readily spin-dried using a powered tool.

Yet another object of the invention is to provide an improved drain auger which prevents large quantities of drain debris from being drawn into the snake-containing auger cavity.

Still another object of the invention is to provide an improved drain auger which may be cleaned by immersion in water.

Another object of the invention is to provide an improved drain auger which is easy to use by persons with smaller, less powerful hands. Other objects of the invention will become more apparent from the following description of the preferred embodiments.

SUMMARY OF THE INVENTION

The invention is an improvement in drain-cleaning augers of the type having a round shell made from first and second subshells and a cavity within the shell for containing a coiled auger-like snake. A stem extends from the shell and the snake is clamped within the stem. As drain cleaning progresses, the snake is unclamped and an additional length of snake is extended into the drain. One type of known snake is made of a lengthy, tightly-wound coil of rigid wire or the like and has a spiral groove formed by the coiled wire. As is explained below, such groove undesirably "captures" water and debris on the snake.

In the improved auger, the first subshell has an endwall and a skirt-like sidewall extending from it. The sidewall is flared to a first edge of maximum diameter. That is, the inside diameter of the first subshell increases when viewed from the endwall toward the first edge and is at a maximum at the first edge. The second subshell, which is attached to the first subshell to form the snake-containing cavity, has a second edge in close proximity to the first edge. The edges define an opening between them permitting expulsion of water from the cavity by centrifugal force when the shell is power-rotated at high speed. In that way, the auger is self-drying.

Specifically, water is entrained on the snake and drawn into the cavity when the snake is withdrawn following cleaning. The arrangement of the inventive auger permits all or substantially all of such water, which is usually objectionably odorous, to be quickly and easily expelled through the opening.

The precise form of such opening is not critical. For example, it may be a crack or interstice between the edges. Or one or several slit-like openings may be formed at the juncture of the edges to permit water to flow therethrough.

Expulsion of such water has at least two advantages. One is that the auger is much less likely to give off offensive odors when stored following drain cleaning. Another is that removal of such water, which may contain drain-cleaning chemicals, helps prevent rust and/or corrosion of the snake. The useful life of the auger is thereby greatly extended.

In a highly preferred embodiment, one of the subshells (preferably that having the flared sidewall) includes at least one aperture or utility window communicating with the cavity. Through this window, clean rinse water may be quickly introduced into the cavity, either by pouring it through the window or by immersing the shell in a container of water. The auger also advantageously includes a second utility window and, preferably, both windows are formed in the endwall of the first subshell. The second window permits air to be drawn into the cavity when rinse water is poured from the cavity through the first window. Quick cleanup is thereby facilitated.

And lubricating oil may be introduced into the cavity through either window following final water expulsion by spin-drying. When the shell is again rotated at high speed, such oil coats the snake to help prevent rust and corrosion.

To facilitate immersion of the auger for cleanup while yet avoiding the possible risks attending wetting of the driving power unit (such as an electrically-powered hand drill), the auger includes a drive attachment for detachably coupling the power unit to the auger. After detachment of the power unit, rinse water may be introduced into the cavity by simply immersing the shell in water.

Earlier known augers have a generally cylindrical clamp nut which is tightened to maintain the snake at a selected extended length and loosened to extend or retract the snake. It has been discovered that such clamp nuts are sometimes difficult to manipulate, especially by persons with small hands. Accordingly, the improved auger includes a clamping cone having a cylindrical portion and a conical portion. It has been found that the combined cylindrical and conical shape is much easier to grip. Typically, the thumb and forefinger are used to grip the conical portion while the remaining fingers and ball of the thumb are closed toward one another to more readily grip the cylindrical portion. And gripping force (and the ability to twist the cone to a release or clamp position) is further improved by the inclusion of a plurality of grooves formed along the length of the cone.

As noted above, the spiral groove extending the length of the snake has a tendency to trap debris as the snake is withdrawn from a drain. To the extent such debris is permitted to enter the shell, it retains water and is likely to give off an objectionable odor. Such problem is largely overcome by the configuration of the tip of the clamping cone which has an axial passage through which the snake is extended and retracted. The diameter of the passage is selected to provide only slight clearance between the passage wall and the snake. The tip thereby strips a great deal of debris from the snake as it is retracted into the cavity.

For most efficient water expulsion, it is preferred that the shell be power-driven at a relatively high speed of at least a few hundred revolutions per minute. In other words, hand cranked rotation is not effective for substantially complete water removal. At higher speeds, the first subshell is susceptible to deformation and even breakage due to the mass of the snake confined in the cavity. To help maintain rigidity, the first subshell includes interior reinforcing ribs. Preferably, such ribs extend radially outward from the subshell center toward the flared sidewall. Such ribs have a height selected to extend an appreciable portion of the dimension between the endwall and the edge of maximum diameter. That is, such ribs are blade-like. When so formed, the ribs function somewhat like fan blades and urge air toward the opening between the proximate edges of the first and second subshells. Such ribs thereby create a slight positive air pressure within the cavity to aid expulsion of water from the cavity and further promote drying of the snake. It has also been found that such ribs support the snake as it is loaded into the cavity during manufacture. Loading is thereby made easier.

Further details of the inventive auger are set forth in the detailed description taken in conjunction with the drawing.

DETAILED DESCRIPTION OF PREFERRED EMBODIMENTS

Figure 1:
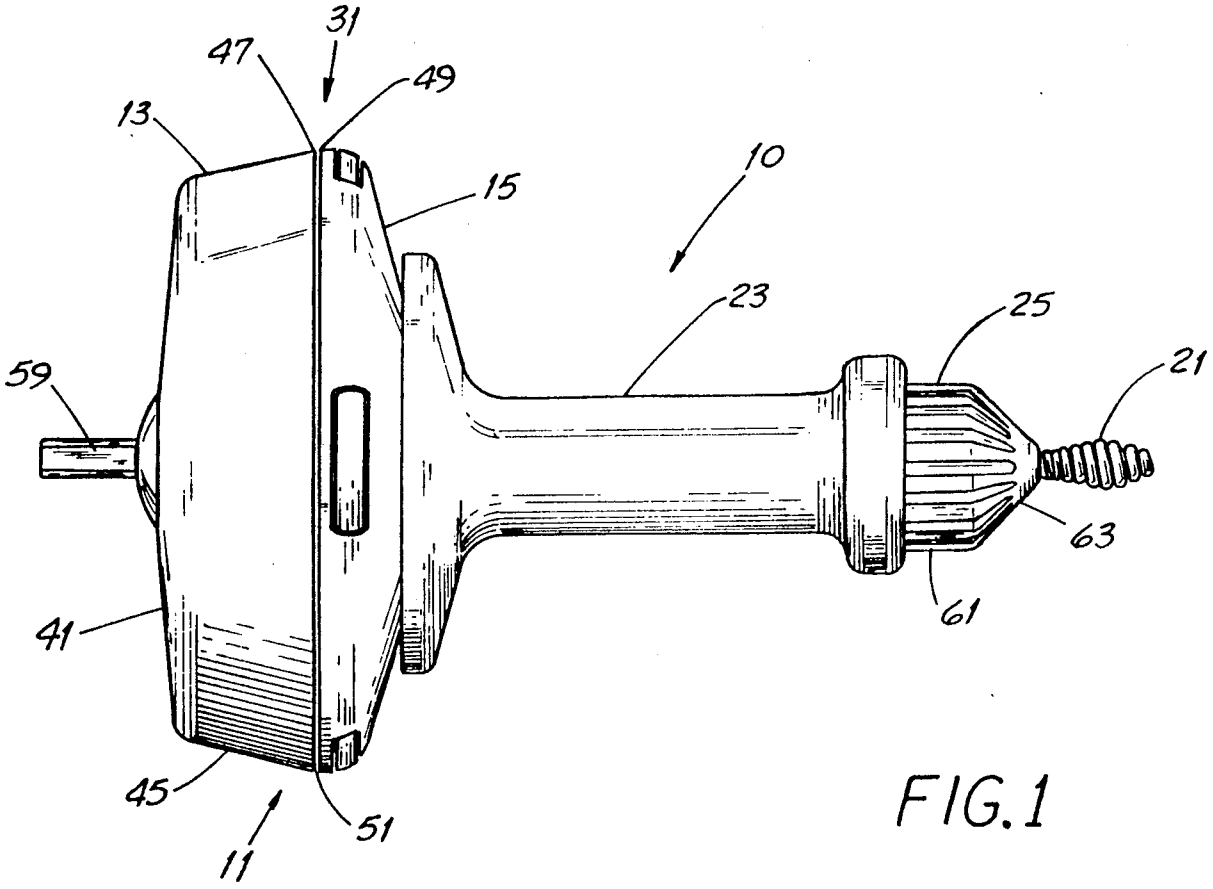
FIG. 1 is an elevation view of the improved auger.
Figure 2:
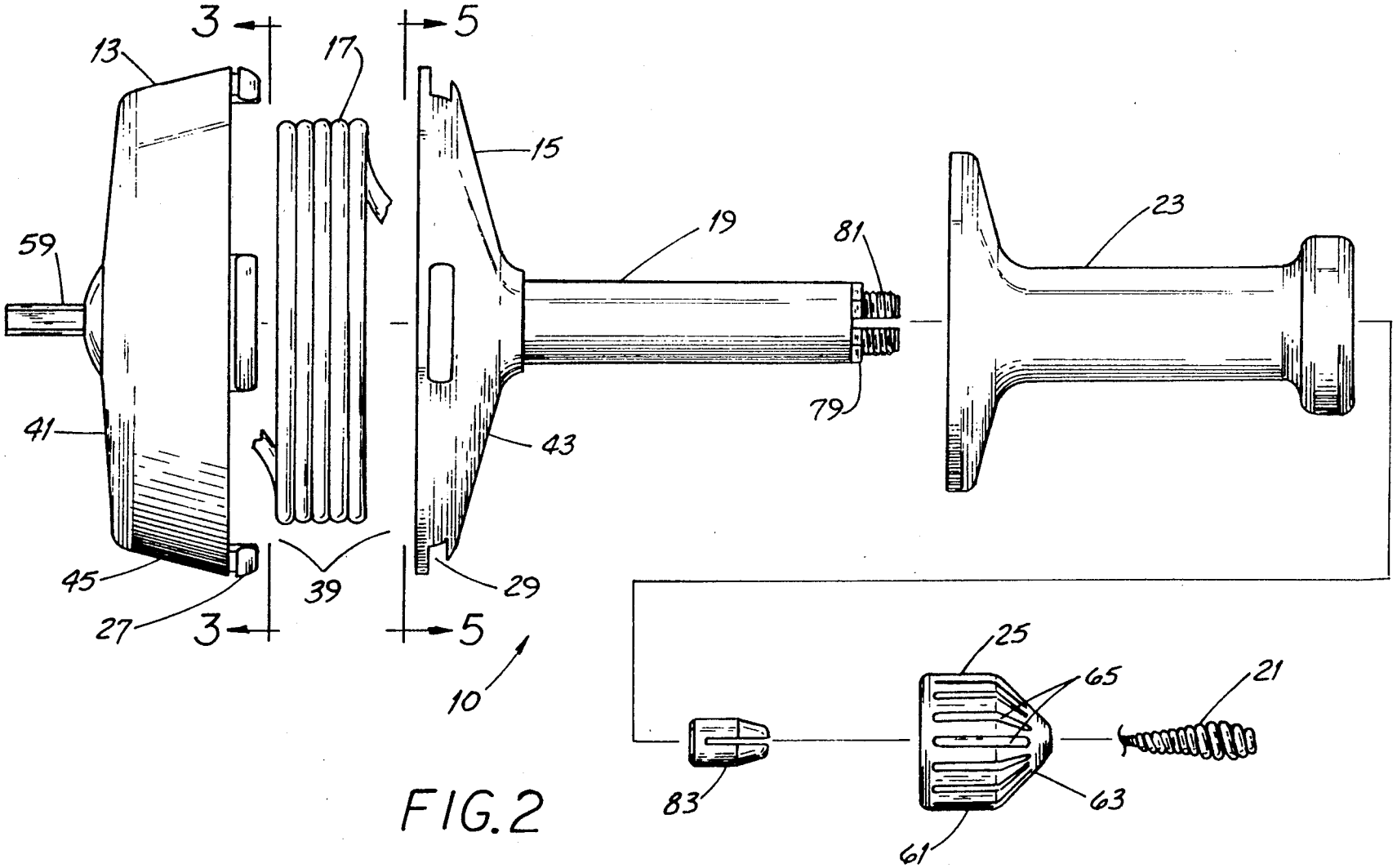
FIG. 2 is an exploded view of the auger of FIG. 1 with parts broken away.
Figure 3:
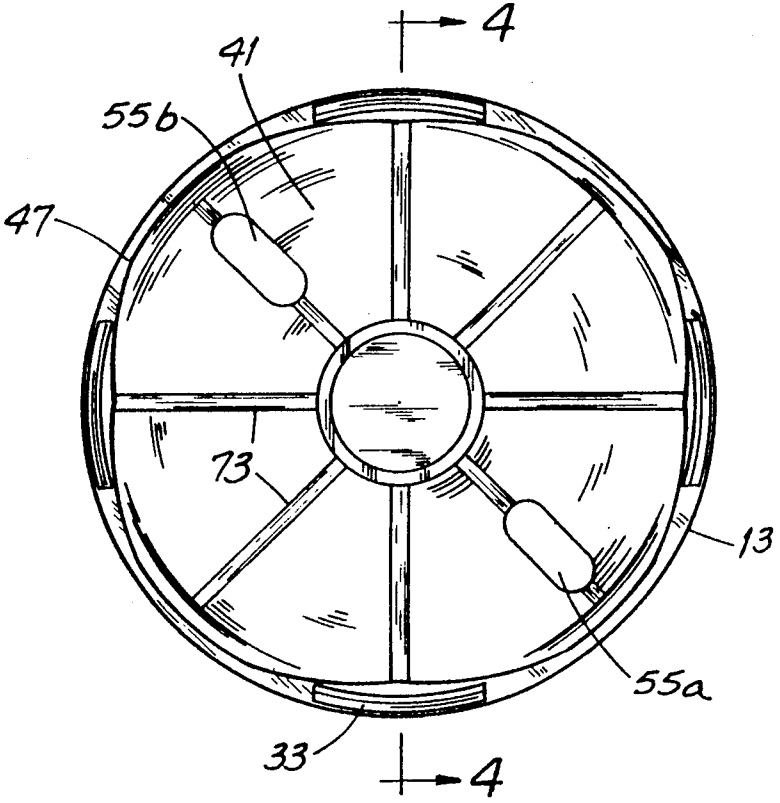
FIG. 3 is a view of the first subshell portion of the auger taken along the viewing plane 3—3 of FIG. 2.
Figure 4:
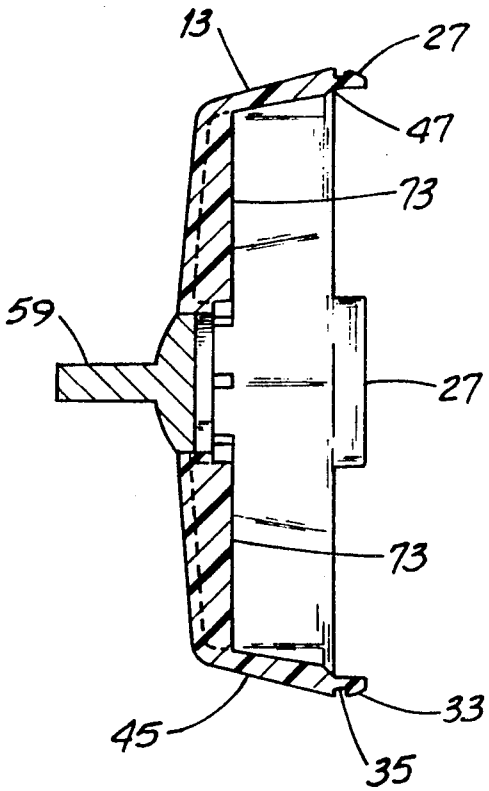
FIG. 4 is a cross-sectional view taken along the viewing plane 4—4 of FIG. 3.
Figure 5:
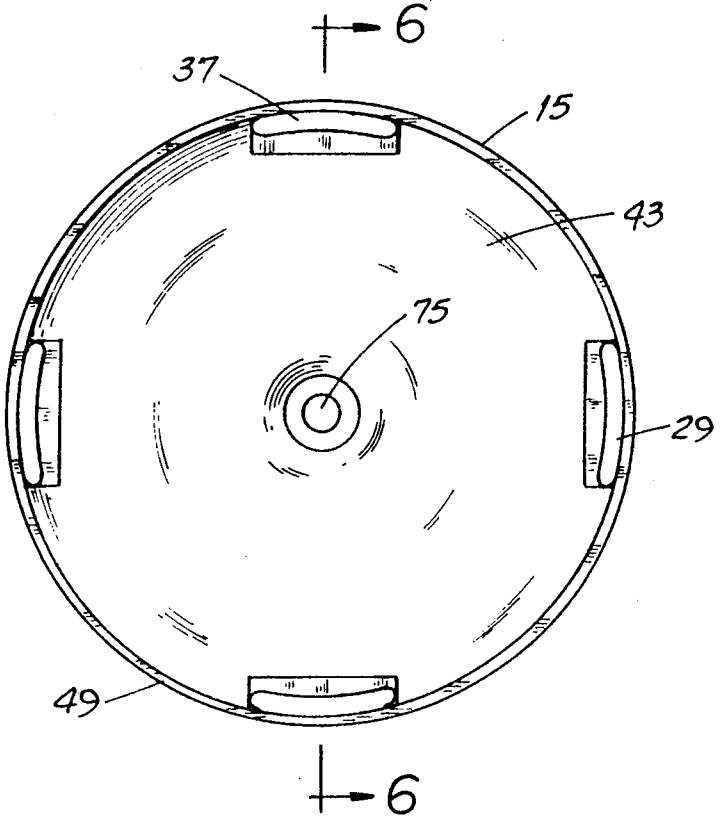
FIG. 5 is a view of the second subshell portion of the auger taken along the viewing plane 5—5 of FIG. 2.
Figure 6:
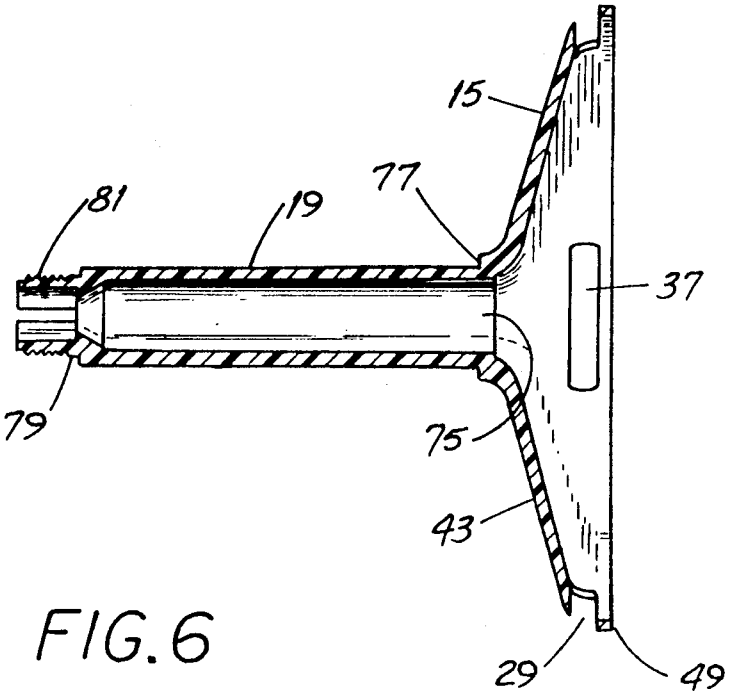
FIG. 6 is a cross-sectional view taken alone the viewing plane 6—6 of FIG. 5.
Figure 10:
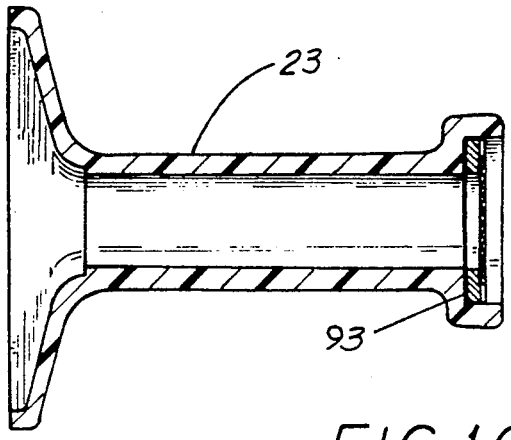
FIG. 10 is a cross-sectional view of the gripping handle of the improved auger.

The FIGURES illustrate the improved drain auger 10 in accordance with this invention. Referring first to FIGS. 1 and 2, the improved drain auger 10 includes a shell 11 made from two subshells 13, 15 and a flexible snake 17 which is coiled within the shell 11. A stem 19 protrudes axially from the subshell 15 and has one end 2 of the snake, that which first enters a clogged drain, extending through the stem 19 to the exterior of the auger 10. A gripping handle 23 is mounted on the stem 19 with slight clearance so that the shell 11, stem 19 and snake 17 can rotate with respect to the gripping handle 23 during drain cleaning. A clamping cone 25 is threaded onto the stem 19 and is tightened to secure the snake 17 so that it is prevented from withdrawing into the shell 11 as the end 21 is urged into the clogged drain. The cone 25 is loosened to further extend the snake 17 or to permit the snake 17 to be retracted into the shell 11 after the drain is unclogged.

Referring additionally to FIGS. 3–6, the subshells 13 and 15 are snapped together by means of four pairs of male and female mating means 27, 29, respectively, which are spaced at equal intervals around the shell sidewall 31. The male mating means 27 includes an elongate portion 39 mounted on a resilient finger 35 and the female mating means 29 are elongate slots 37 through the subshell 15. As the subshells 13, 15 are urged toward one another during assembly of the auger 10, the portions 33 "snap into" the slots 37 to hold the subshells 13, 15 together and form the snake-containing cavity 39.

The shell 11, preferable molded of high density polyethylene, has first and second end walls 41, 43, respectively, which are parts of first and second subshells 13 and 15, respectively. The first subshell 13 has a skirt-like sidewall 45 extending from the endwall 41. The sidewall 45 is flared to a first edge 47 of maximum diameter. That is, the inside diameter of the first subshell 13 increases when viewed from the endwall 41 toward the first edge 47 and is maximum at the first edge 47.

The second subshell 15 has a second edge 49 in close proximity to the first edge 47 to define an opening 51 between the edges 47, 49. Such opening 51 permits expulsion of water by centrifugal force from the cavity 39 within the shell 11 when the shell 11 is power rotated at high speed. The auger 10 is thereby self-drying.

Specifically, dirty water is often entrained on the snake 17 and drawn into the cavity 39 when the snake is withdrawn from a drain following cleaning. The arrangement of the inventive auger 10 permits all or substantially all of such water, which is usually objectionably odorous, to be quickly and easily expelled through the opening 51.

Figure 7:
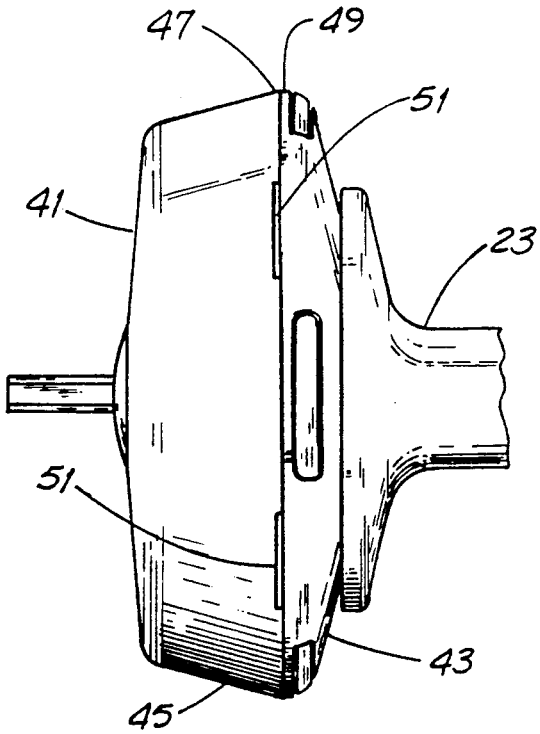
FIG. 7 is similar to the view of FIG. 1 and is an elevation view of a variation of the improved auger, with parts broken away.
Figure 9:
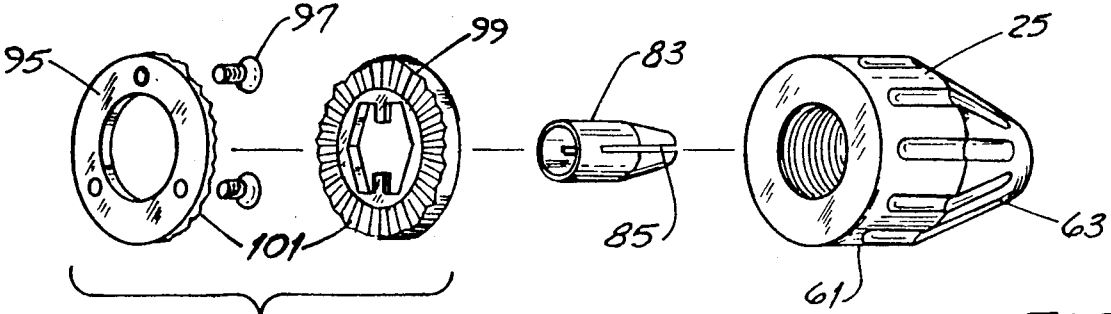
FIG. 9 is a perspective view of certain parts of the improved auger.

The precise form of such opening 51 is not critical. For example, it may be a crack or interstice between the edges 47, 49 as shown in FIG. 1. Or, as shown in FIG. 7, one or several slit-like openings 51 are formed at the juncture of the edges 47, 49 to permit water 53 to flow therethrough.

Expulsion of such water 53 has at least two advantages. One is that the auger 10 is much less likely to give off offensive odors when stored following drain cleaning. Another is that removal of such water 53, which may contain drain-cleaning chemicals, helps prevent rust and/or corrosion of the snake 17. The useful life of the auger 10 is thereby greatly extended.

In a highly preferred embodiment, one of the subshells 13, 15 (preferably subshell 13 having the flared sidewall 45) includes at least one aperture or utility window 55*a* communicating with the cavity 39. Through this window 55*a*, clean rinse water may be quickly introduced into the cavity 39, either by pouring it through the window 55*a* or by immersing the shell 11 in a container of water. The auger 10 also advantageously includes a second utility window 55*b* and, preferably, both windows 55*a*, 55*b* are formed in the endwall 41 of the L first subshell 13. The second window 55*b* permits air to be drawn into the cavity 39 when rinse water is poured from the cavity 39 through the first window 55*a*. Quick cleanup is thereby facilitated.

And lubricating oil may be introduced into the cavity 39 through either window 55*a*, 55*b* following final water expulsion by spin-drying. When the shell 11 is again rotated at high speed, such oil coats the snake 17 to help prevent rust and corrosion.

To facilitate immersion of the auger 10 for cleanup while yet avoiding the possible risks attending wetting of the driving power unit 57 (such as an electrically-powered hand drill), the auger 10 includes a drive attachment 59 for detachably coupling the power unit 57 to the auger 10. After detachment of the power unit 57, rinse water may be introduced into the cavity 39 by simply immersing the shell 11 in water.

Earlier known augers have a generally cylindrical clamp nut which is tightened to maintain the snake 17 at a selected extended length and which is loosened to extend or retract the snake ;7. It has been discovered that such clamp nuts are sometimes difficult to manipulate, especially by persons with smaller, less powerful hands. Accordingly (and referring particularly to FIGS. 1, 2, 8 and 9), the improved auger 10 includes a clamping cone 25 having a cylindrical portion 61 and a conical portion 63. It has been found that the combined cylindrical and conical shape is much easier to grip. Typically, the thumb and forefinger are used to grip the conical portion 63 while the remaining fingers and ball of the thumb are closed toward one another to more readily grip the cylindrical portion 61. And gripping force (and the ability to twist the cone 25 to a release or clamp position) is further improved by the inclusion of a plurality of grooves 65 formed along the length of the cone 25.

As noted above, the spiral groove 66 extending the length of the snake 17 has a tendency to trap debris as the snake 17 is withdrawn from a drain. To the extent such debris is permitted to enter the shell 11, it retains water 53 and is likely to give off an objectionable odor. Such problem is largely overcome by the configuration of the tip 67 of the clamping cone 25 which has an axial passage 69 through which the snake 17 is extended and retracted. The diameter of the passage 69 is selected to provide only slight clearance between the passage wall 71 and the snake 17. The tip 67 thereby strips a great deal of debris from the snake 17 as it is retracted into the cavity 39.

For most efficient water expulsion, it is preferred that the shell 11 be power-driven at a relatively high speed of at least a few hundred revolutions per minute. In other words, hand cranked rotation is not effective for substantially complete water removal. At higher speeds, the first subshell 13 is susceptible to deformation and even breakage due to the mass of the snake 17 confined in the cavity 39. To help maintain rigidity, the first subshell 13 includes interior reinforcing ribs 73. Preferably, such ribs 73 extend radially outward from the subshell center toward the flared sidewall 45.

Such ribs 73 have a height selected to extend an appreciable portion of the dimension between the endwall 41 and the edge 47 of maximum diameter. That is, such ribs are blade-like. When so formed, the ribs 73 function somewhat like fan blades and urge air toward the opening 51 between the proximate edges 47, 49 of the first and second subshells 13, 15. Such ribs 73 thereby create a slight positive air pressure within the cavity 39 to aid expulsion of water 53 from the cavity 39 and further promote drying of the snake 17. It has also been found that such ribs 73 support the snake 17 as it is loaded into the cavity 39 during assembly of the auger 10. Loading is thereby made easier.

The subshell 15 has an axial opening about which the proximal end 77 of the stem 19 is secured. Preferably, the stem 19 and the subshell 15 are integrally formed by molding as one piece. The stem 19 extends from the proximal end 77 to a distal end 79 and the handle 23 is concentrically and rotatably mounted on the stem 19.

Figure 8:
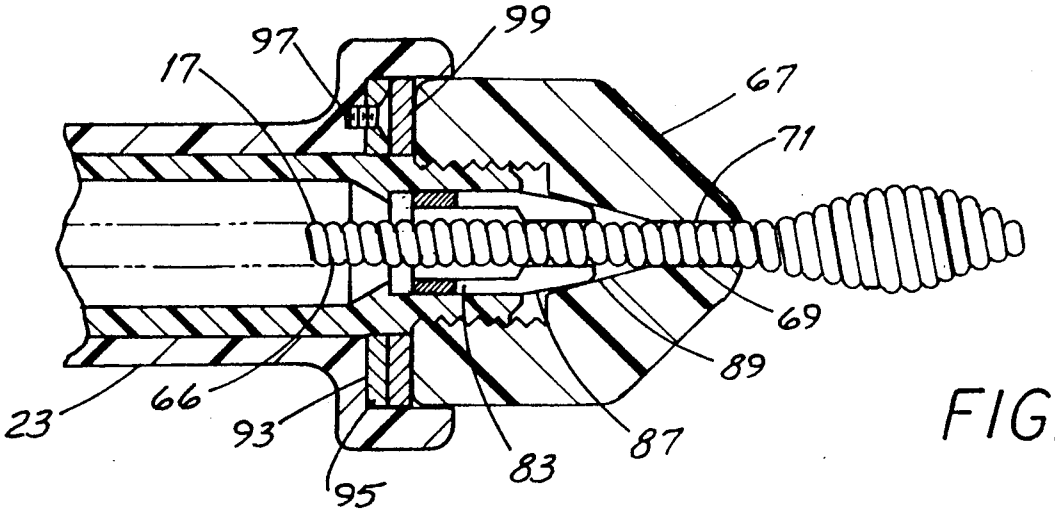
FIG. 8 is a cross-sectional view of a portion of the auger shown in FIG. 1 with parts broken away and other parts shown in dashed outline.

As shown in FIG. 8, the distal end 79 of the stem 19 has an externally threaded male part 81 to which the clamping cone 25 is adjustably screwed. A collet member 83 is secured at the distal end 79 of the stem 19 and has splits 85 in it and an annular tapered outward surface 87. This outward surface 87 is engaged by a conformably-shaped annular tapered inward surface 89 on the clamping cone 25. The snake 17 passes through the collet member 83 and may be clamped or released by the collet member 83 depending upon the position of the cone 25. This structure provides means to clamp the snake 17 to the stem 19 in selected axial positions depending on the length of snake 19 which the operator has pulled from the cavity 39.

It has been found that the auger 10 is significantly more effective in cleaning drains when vibratory motion is imparted to the snake 17. Accordingly, the improved auger includes means 91 to impart such vibratory motion to the snake, such motion allowing the snake 17 to pass traps and other obstacles in a drain with ease.

More particularly, the gripping handle 23 includes an axially-facing annular ledge 93 to which a first vibratory member 95 is non-rotatably secured by screws 97. Because the gripping handle 23 moves only axially as the snake 17 is urged into or withdrawn from a drain, the member 95 moves only axially; that is, it does not rotate. A second vibratory member 99 is keyed to the stem 19 and rotates with it. Each member 95, 99 includes a surface having radially-spaced, axially-extending teeth 101 which engage those of the opposing member when the members 95, 99 are urged toward one another. The teeth 101 are formed in such a way that the member 99 can rotate with respect to the member 95 even when the members 95, 99 are in contact with one another.

Vibration only occurs when axial pressure has been applied by the handle 23 toward the distal end 79 and on the snake 17 as the snake 17 meets obstacles within the drain to be unclogged. As the gripper handle 23 is urged rearward toward the shell 11, the members 95, 99 are separated by a small space and vibratory motion stops. Further details regarding the vibration-imparting mechanism are shown and described in my U.S. Pat. No. 4,793,017 (Kaye).

In operation, a length of snake 17 is pulled out of the shell 11 through the stem 19 and clamped at a position by the clamping cone 25. Users find it convenient to grip the conical portion 63 using the thumb and index finger and the cylindrical portion 61 using the remaining fingers and ball of the thumb. The gripping handle 23 is grasped with one hand, a power unit 57 is coupled to the drive attachment 59, the snake 17 is extended into the clogged drain to the area of obstruction and the power unit 57 turned on. This causes the shell 11, the stem 19, the cone 25 and the snake 17 to rotate at the same speed While the gripping handle 23 is non-rotatably held. Force is exerted on the handle 23 to urge the snake 17 toward the obstruction. When so doing, the snake 17 is vibrated.

After the obstruction is cleared, the cone 25 is loosened and the snake 17 is retracted into the cavity 39. Since the passage 69 in the tip 67 of the cone 25 is only very slightly larger in diameter than the snake 17, the tip 67 strips debris from the snake 17 as it is retracted.

Figure 11:
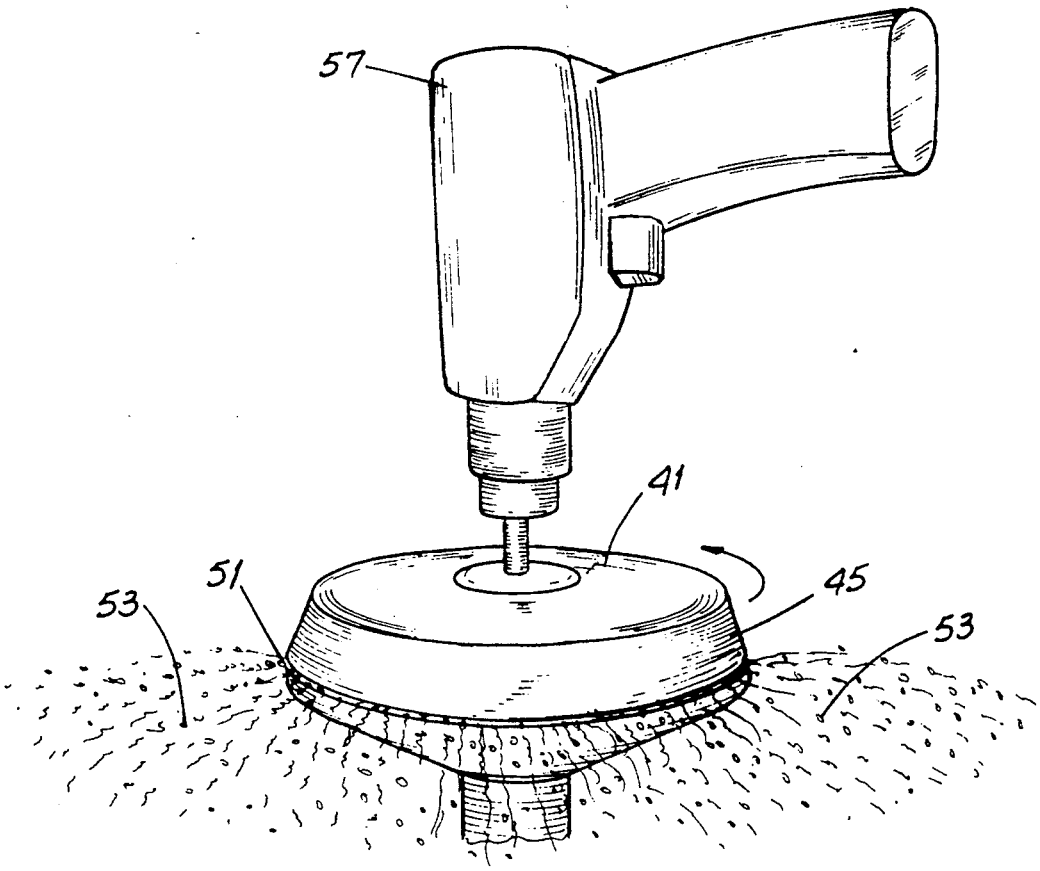
FIG. 11 is a perspective view, with parts broken away, illustrating the "spin-dry" feature of the improved auger.

Referring to FIG. 11 it is assumed that dirty water 53 was entrained on the retracted snake 17 and that such water 53 is now lodged within the cavity 39. The power unit 57 is re-energized and the water 53 is expelled through the opening 51 and flies radially outward. Expulsion is primarily by centrifugal force although slight positive air pressure within the cavity 39 also urges the water 53 through the opening 51.

If the operator desires to rinse the cavity 39 with clear water, such water may be poured through one of the windows 55*a*, 55*b* or, after removing the power unit 57, the auger 10 may be immersed in water. After introduction of clear water, the power unit 57 is again attached and energized, causing expulsion of water as described above and shown in FIG. 11. Finally, the operator may wish to oil the snake 17 before storing the auger 10. A quantity of oil is introduced through a window 55*a*, 55*b* and the attached power unit 57 again energized. The oil is spun around inside the cavity 39 to protectively coat the snake 17. When performing spin-drying or oiling operations, it is preferred to confine the auger 10 within a bucket or other enclosure to avoid scattering water or oil over a large area.

While the principles of this invention have been described in connection with specific embodiments, it should be understood clearly that these descriptions are made only by way of example and are not intended to limit the scope of the invention.

I claim:

1. In a drain-cleaning auger of the type having a snake and a round shell made from first and second subshells connected to one another to define a snake-containing cavity within such shell, the improvement wherein:

the first subshell has a sidewall flared to a first edge of maximum diameter;

the second subshell has a sidewall flared to a second edge of maximum diameter, the second edge being in intermittant contact with the first edge to define plural openings between the edges for expelling water from the cavity by centrifugal force when the shell is power-rotated at high speed; and, no portion of the snake passe through an opening, thereby permitting unobstructed water expulsion, whereby the auger is self-drying.

2. The auger of claim 1 wherein one of the subshells includes at least one axially-offset utility window communicating with the cavity whereby rinse water may be quickly introduced into the cavity.

3. The auger of claim 2 further including a second utility window through which air is drawn into the cavity when rinse water is poured from the cavity through the first window.

4. The auger of claim 2 wherein such utility window permits introduction of oil into the cavity whereby corrosion of the snake is substantially inhibited.

5. The auger of claim 1 further including a stem extending from the shell and a snake clamped within the stem by a clamping cone having a cylindrical gripping portion and a conical gripping portion whereby such cone may be readily gripped along such portions and turned for snake clamping and release.

6. The auger of claim 5 wherein the conical portion includes a plurality of grooves formed therein for improved gripping.

7. The auger of claim 1 further including a stem extending from the shell and a snake clamped within the stem by a clamping cone having a tip through which the snake is extended and retracted with slight clearance, such tip thereby stripping debris from the snake as it is retracted into the cavity.

8. The auger of claim 7 wherein the clamping cone has a cylindrical portion and a conical portion whereby such cone may be readily gripped.

9. The auger of claim 1 wherein the first subshell includes interior radially-oriented reinforcing ribs maintaining the rigidity of the first subshell during high speed power rotation thereof.

10. The auger of claim 9 wherein such reinforcing ribs are blade-like and aid expulsion of water from the cavity by air pressure.

* * * * *

UNITED STATES PATENT AND TRADEMARK OFFICE

CERTIFICATE OF CORRECTION

PATENT NO. : 5,173,984

DATED : December 29, 1992

INVENTOR(S) : Paul S. Kaye

It is certified that error appears in the above-identified patent and that said Letters Patent is hereby corrected as shown below:

In column 4, line 23, delete "2" and insert --21--.

In column 5, line 24, delete "L".

In column 5, line 44, delete ";7" and insert --17--.

In column 7, line 23, delete "While" and insert --while--.

In column 8, line 17, delete "passe" and insert --passes--.

Signed and Sealed this

Nineteenth Day of October, 1993

*Attest:*

Bruce Lehman

BRUCE LEHMAN

*Attesting Officer*

*Commissioner of Patents and Trademarks*